US005456172A

United States Patent [19]

Herrmann

[11] Patent Number: 5,456,172

[45] Date of Patent: Oct. 10, 1995

[54] SCREEN PRINTING MACHINE AND METHOD FOR ASSEMBLING SAME

[75] Inventor: Marc L. Herrmann, Mahwah, N.J.

[73] Assignee: Interchange Equipment, Inc., Passaic, N.J.

[21] Appl. No.: 142,866

[22] Filed: Oct. 25, 1993

[51] Int. Cl.[6] ..... B41F 15/10

[52] U.S. Cl. ..... 101/115; 101/126; 101/129; 101/479

[58] Field of Search ..... 101/114, 115, 101/123, 126, 129, 479, 480, 193, 196

[56] References Cited

U.S. PATENT DOCUMENTS

| | | | |
|---|---|---|---|
| Re. 29,160 | 3/1977 | Jaffa | 101/123 |
| 3,719,141 | 3/1973 | Jaffa et al. | 101/126 |
| 3,795,189 | 3/1974 | Jaffa | 101/123 |
| 3,885,493 | 5/1975 | Jaffa | 101/123 |
| 3,889,595 | 6/1975 | Jaffa | 101/116 |
| 3,977,322 | 8/1976 | Jaffa | 101/126 |
| 4,031,825 | 6/1977 | Jaffa | 101/126 |
| 4,273,044 | 6/1981 | Brasa | 101/193 |
| 4,407,195 | 10/1983 | Jaffa | 101/126 |
| 4,517,894 | 5/1985 | Davis et al. | 101/126 |
| 4,735,139 | 4/1988 | Szarka | 101/126 |
| 4,909,146 | 3/1990 | Szarka | 101/126 |
| 5,090,311 | 2/1992 | Brasa | 101/115 |
| 5,213,033 | 5/1993 | Bourgeois et al. | 101/116 |

*Primary Examiner*—Edgar S. Burr
*Assistant Examiner*—Stephen R. Funk
*Attorney, Agent, or Firm*—Lerner, David, Littenberg, Krumholz & Mentlik

[57] ABSTRACT

A serigraphic printing apparatus having increased color and printing station/open station capabilities. The apparatus is constructed by linking two independent and obsolete screen printing machines together by a unique assembly to enable multi-function synchronized operation.

5 Claims, 4 Drawing Sheets

SCREEN PRINTING MACHINE AND METHOD FOR ASSEMBLING SAME

BACKGROUND OF THE INVENTION

The present invention relates in general to a serigraphic printing apparatus, such as a screen printing machine for the automatic printing of multi-color images in the textile industry. More particularly, the present invention relates to the operative interconnecting of existing obsolete screen printing machines to create a new machine having increased color and printing station/open station capabilities.

Modern day screen printing machines are adapted to index articles to be printed upon between individual printing stations for the purpose of receiving multi-color print images. One such screen printing machine which has enjoyed commercial success is disclosed in, for example, U.S. Pat. No. 3,795,189. In general, the screen printing machine includes an oval track or rail about which a series of pallets supporting an article are indexed from station to station. A printhead assembly having one or more color stations is operatively associated for movement into and out of printing relationship with one or more of the pallets as the pallets are indexed. These known screen printing machines are limited in the number of available printing stations and the ability to accommodate flashing within the printhead assembly.

In the area of textile screen printing, the imprinted sportswear industry has experienced dramatic changes over the past four years. As a result, there has been a vast increase in the number of colors used, and therefore, the number of printing stations required. In addition, the more sophisticated color patterns being designed and type of ink systems being used frequently require a number of open stations or stations available for intermediate flashing. Consequently, known machines manufactured in the conventional oval configuration, for example, with six, eight or ten colors and limited open printing stations for flashing have become obsolete. These obsolete screen printing machines represent a substantial investment for the textile screen printer. Accordingly, there is an unsolved need to enable use of these obsolete screen printing machines to accommodate the current trend in the textile screen printing industry which requires increased color and printing station/open station capabilities.

SUMMARY OF THE INVENTION

It is broadly an object of the present invention to provide a serigraphic printing apparatus for use in the textile industry providing enhancement in the number of printing stations and stations available for intermediate flashing.

Another object of the present invention is to provide for interconnecting two independent and obsolete screen printing machines into a new single screen printing machine having multi-function control capability.

Another object of the present invention is to provide for linking two independent and obsolete screen printing machines together to provide double the number of color and printing station capacity, e.g., two eight color, sixteen station oval configured machines becoming a single unitary sixteen color, thirty-six station screen printing machine.

In accordance with one embodiment of the present invention there is provided an apparatus for screen printing articles, the apparatus comprising a first frame supporting a plurality of movable first article support plates underlying a first printhead, a second frame supporting a plurality of movable second article support plates underlying a second printhead, and interconnecting means for operatively connecting the first and second frames together, whereby the plurality of first and second article support plates are movable in operative association through the first and second printheads.

In accordance with another embodiment of the present inventions there is provided an apparatus for screen printing of articles, the apparatus comprising a first frame supporting a plurality of first pallet support plates, a first printhead operatively associated with the plurality of first pallet support plates, and first transfer means for conveying the plurality of first pallet support plates through the first printhead; a second frame supporting a plurality of second pallet support plates, a second printhead operatively associated with the plurality of second pallet support plates, and second transfer means for conveying the plurality of second pallet support plates through the second printhead; and interconnecting means for connecting together the first and second frames in fixed spaced relationship and the first and second transfer means, whereby the plurality of first and second pallet support plates are movable along a continuous closed path through the first and second printheads.

In accordance with another embodiment of the present invention there is provided an apparatus for screen printing of articles, the apparatus comprising a first frame supporting a plurality of first pallet support plates, a first printhead operatively associated with the plurality of first pallet support plates, a plurality of first printing stations within the first printhead respectively registerable with the plurality of first pallet support plates, and first transfer means for conveying the plurality of first pallet support plates through the first printhead and into registration with the plurality of first printing stations; a second frame supporting a plurality of second pallet support plates, a second printhead operatively associated with the plurality of second pallet support plates, a plurality of second printing stations within the second printhead respectively registerable with the plurality of second pallet support plates, and second transfer means for conveying the plurality of second pallet support plates through the second printhead and into registration with the plurality of second printing stations; and interconnecting means for connecting together the first and second frames in fixed spaced relationship and the first and second transfer means to form a continuous closed path in the shape of an elongated oval through the first and second printheads, a plurality of third pallet support plates arranged between the first and second frames, and support means bridging the first and second frames, whereby the plurality of first, second and third pallet support plates are movable between the first and second printheads while being supported by the support means.

In accordance with another embodiment of the present invention there is provided an assembly for interconnecting a pair of screen printing machines, each of the screen printing machines including a frame supporting a plurality of article support plates moveable along a path in operative association with a printhead, the assembly comprising means for connecting the frames together in spaced relationship, and means for providing a continuous closed path for the movement of the plurality of article support plates through the frames in operative association with the printhead.

In accordance with another embodiment of the present invention there is provided an assembly for interconnecting at least a pair of modified preexisting screen printing machines, each of the screen printing machines including a frame moveably supporting a plurality of pallet support plates operatively associated with a printhead, and transfer means for conveying the plurality of pallet support plates through the printhead, the assembly comprising interconnecting means for connecting the pair of frames together in fixed spaced relationship, means for connecting the first and second transfer means to form a continuous closed path through the pair of screen printing machines having an elongated oval shape, and support means for slidably supporting the plurality of pallet support plates during movement through the space between the frames of the pair of screen printing machines.

In accordance with another embodiment of the present invention there is provided a method of operatively interconnecting a pair of preexisting screen printing machines, each of the machines including a printhead, a plurality of pallet support plates, and a continuous closed path drive chain for advancing the pallet support plates through the printhead, the method comprising connecting the pair of preexisting screen printing machines together in fixed spaced relationship, and forming a single continuous closed path for advancing the pallet support plates through the pair of preexisting screen printing machines.

BRIEF DESCRIPTION OF THE DRAWINGS

The above description, as well as further objects, features and advantages of the present invention will be more fully understood with reference to the following detailed description of a serigraphic printing apparatus, when taken in conjunction with the accompanying drawings, wherein.

DETAILED DESCRIPTION OF THE PREFERRED EMBODIMENTS

Figure 1:
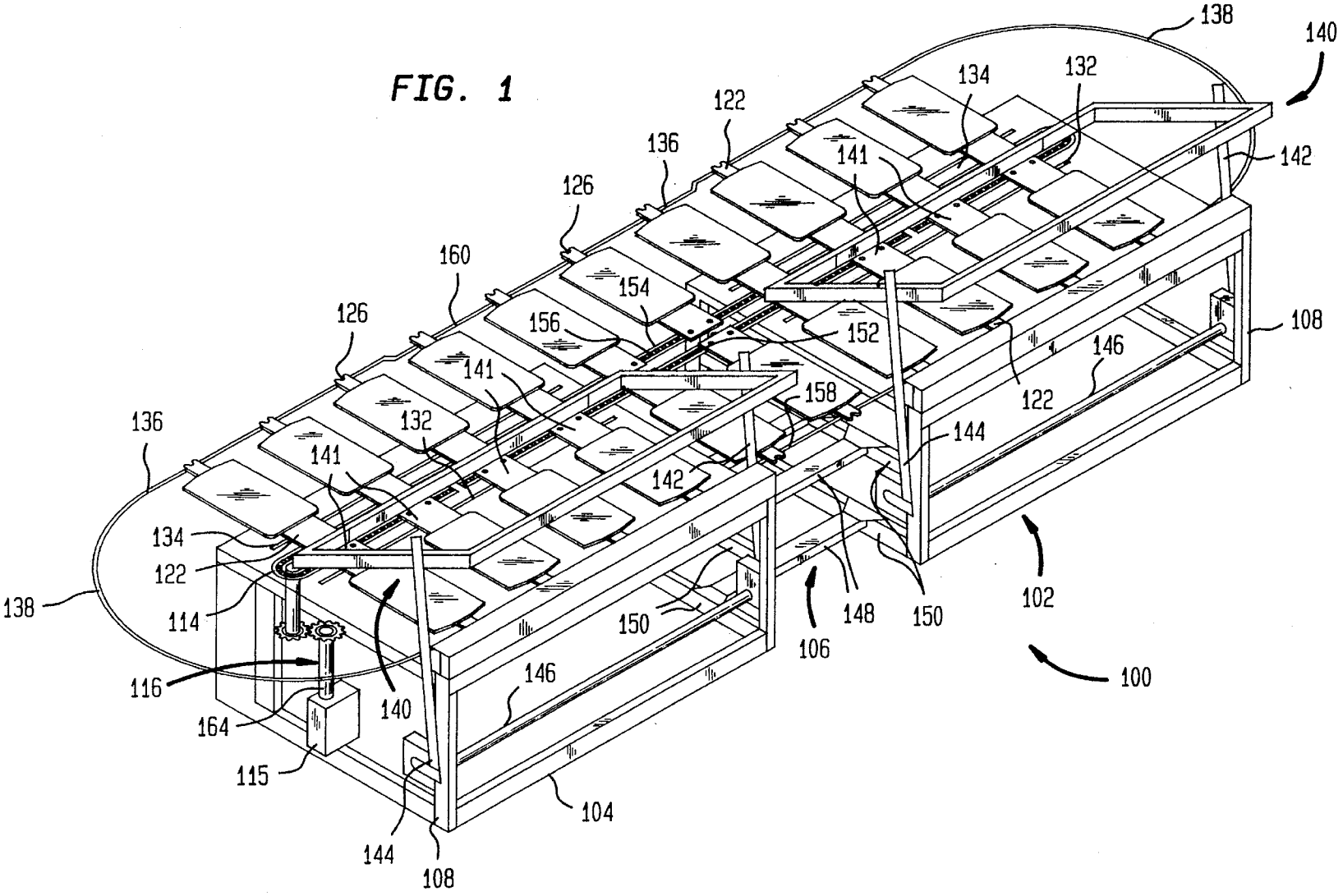
FIG. 1 is a diagrammatic perspective view of a serigraphic printing apparatus constructed in accordance with the present invention by interconnecting two independent and obsolete screen printing machines.
Figure 2:
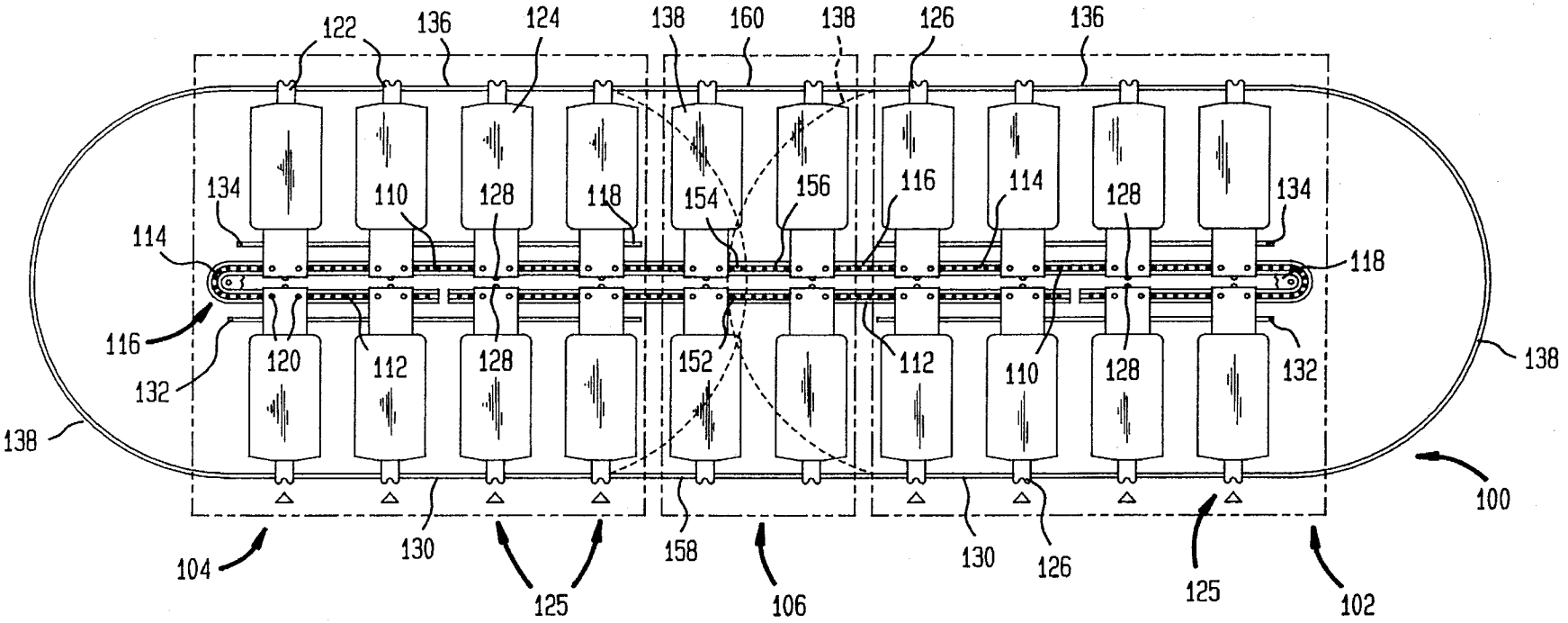
FIG. 2 is a diagrammatic top plan view of the serigraphic printing apparatus shown in FIG. 1, with the printheads removed to illustrate the pallet support plates.

Referring now to the drawings wherein like reference numerals represent like elements, there is shown in FIGS. 1 and 2 a serigraphic printing apparatus generally designated by reference numeral 100. The apparatus 100 is generally constructed from a first obsolete screen printing machine 102, a second obsolete screen printing machine 104, and an interconnecting assembly 106. Each of the screen printing machines 102, 104 are typically refurbished obsolete screen printing machines that have originally been configured with six, eight or ten colors in one printhead without the availability of sufficient intermediate open stations or flashing. Screen printing machines 102, 104 of this type have been available from Precision Screen Machines, Inc. of Hawthorne, New Jersey, Harco of Grand Rapids, Michigan, and Sias Print of Milan, Italy. The specific construction and operation of the screen printing machines 102, 104 are well known in the prior art, for example, as disclosed in U.S. Pat. No. 3,795,189, which disclosure is incorporated herein by reference. Accordingly, the construction and operation of the screen printing machines 102, 104 will only be briefly described.

As originally constructed, each of the screen printing machines 102, 104 includes an open frame 108 which longitudinally supports a pair of parallel spaced apart drive chain guides 110, 112. The original screen printing machines 102, 104 were provided with an endless drive chain 114 supported by the guides 110, 112 to form an elongated oval path. The drive chain 114 was driven at one end by a suitable hydraulic motor 115 via a drive gear assembly 116 and at its other end about an idler gear 118. The drive chain 114 includes a plurality of spaced upstanding pins 120 for removably supporting a plurality of pallet support plates 122. Attached to each of the pallet support plates 122 is a planar pallet 124 adapted for supporting an article to be screen printed.

The pallet support plates 122 are indexed through the screen printing machines 102, 104 from one printing station to the next by means of the drive chain 114 and engaged upstanding pins 120. To ensure accurate registration of each pallet support plate 122, and accordingly its supported pallet 124 with textile article to be screen printed, a locator assembly (not shown) is provided at each printing station. The locator assembly includes a front and rear locator mechanism 125 (see FIG. 3) adapted to releasably engage a notch 126 within the forward end of the pallet support plate 122 simultaneously with a boss 128 protruding from the rearward end thereof. The engagement of the notch 126 and boss 128 by the locator assembly precisely positions the pallet support plate 122 in accurate registration with each of the printing stations during indexing through the screen printing machine 102, 104. The specific construction and operation of the locator assembly is disclosed in U.S. Patent No 4,909,146, which disclosure is incorporated herein by reference.

The pallet support plates 122 while being indexed along one side of the screen printing machines 102, 104, hereinafter referred to as the printing side, are supported by a pair of parallel spaced, longitudinally extending support rails 130, 132. The support rails 130, 132 support the pallet support plates 122 during the screen printing operation. On the opposite side of the screen printing machines 102, 104, hereinafter referred to as the loading/unloading side, the pallet support plates 122 are supported by similar support rails 134, 136. As is conventionally known, support rails 130, 132 and 134 are typically in the form of a rectangular bar having a planar upper surface upon which the under surface of the pallet support plates 124 slidingly rest. On the other hand, the support rail 136 is typically a tubular-shaped elongated member. To provide support of the forward end of the pallet support plates 124 when travelling between the printing and loading/unloading sides, a semi-circular shaped tubular support rail 138 is provided at either end of the screen printing machines 102, 104.

A generally rectangular-shaped printhead assembly 140 supporting a plurality of printing stations 141 is pivotally attached at its rear end overlying the printing side of the screen printing machines 102, 104. The printhead assembly 140 is pivoted between an open position, as shown, and a closed position (not shown) to effect screen printing, by a pair of attached spaced apart lift crank arms 142, 144 operated by a common crank shaft 146. Contained within the printhead assembly 140 at each of the printing stations 141 is the appropriate screen printing components (not shown), such as pattern screen holders, ink flooding assemblies and squeegee holders to effect screening of an article being supported by an underlying pallet 124 which has been brought into registration therewith. The specific construction and operation of the printhead assembly 140 is as described in the aforementioned U.S. Pat. No. 3,795,189. A description of another construction of a printhead assembly 140 is described in U.S. Pat. No. 3,885493, which description is also incorporated herein by reference.

These typically old and obsolete known screen printing machines 102, 104, in the absence of the present invention, would be of little utility in meeting the demands of today's imprinted sportswear industry. To this end, the present invention provides for the interconnection, by operatively joining, of existing obsolete screen printing machines 102, 104 to create a new unitary serigraphic apparatus 100 with increased color and printing station/open station capabilities.

Figure 3:
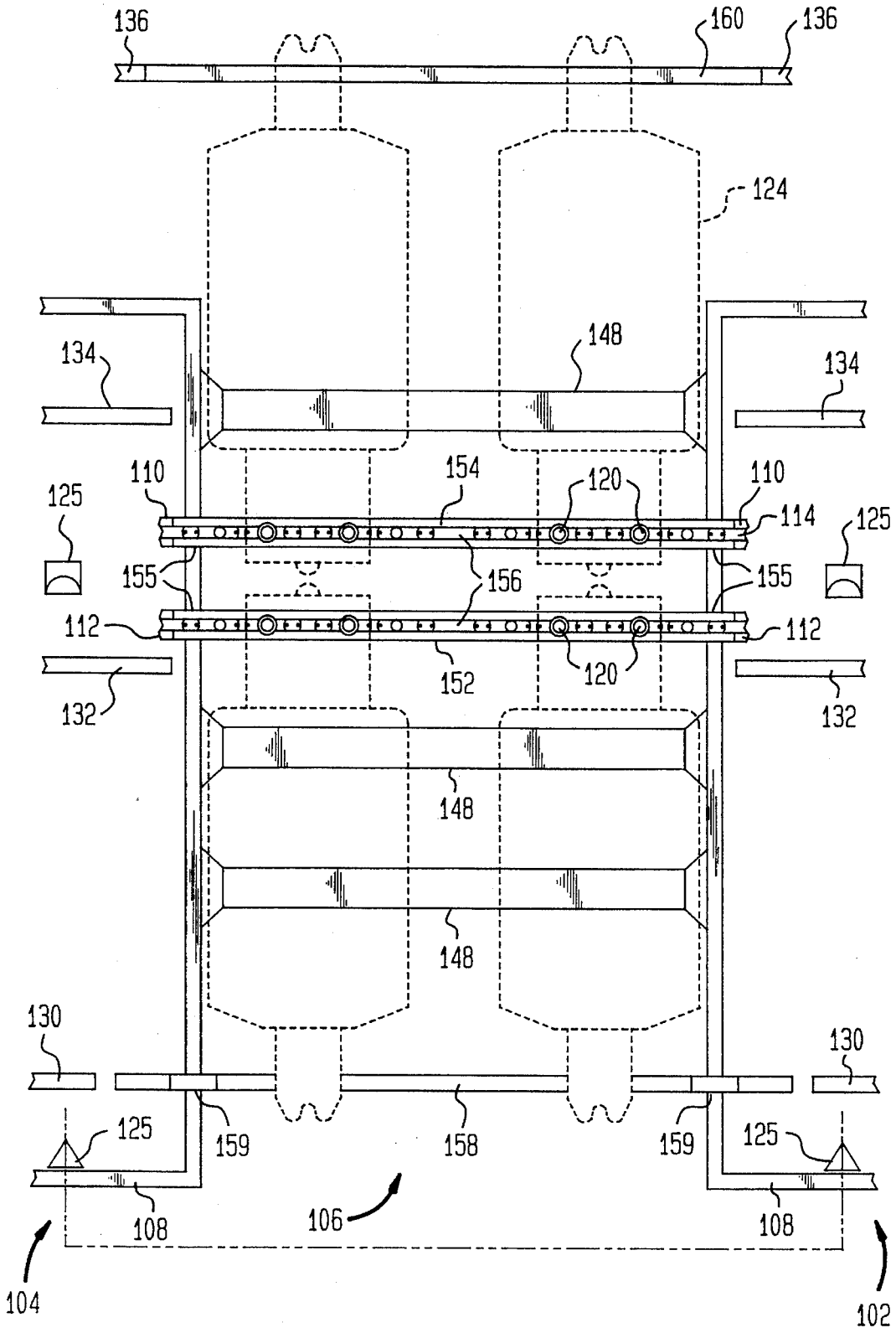
FIG. 3 is a diagrammatic top plan view of the interconnection of two independent and obsolete screen printing machines in accordance with the present invention.

As shown generally in FIGS. 1 and 2, and more specifically in FIG. 3, the existing screen printing machines 102, 104 are initially modified at one end thereof to accommodate their joining by means of the interconnecting assembly 106 pursuant to the present invention. The first existing screen printing machine 102 is modified by removing the left end support rail 138 (shown in phantom). In a similar manner, the right end support rail 138, also shown in phantom, of the second existing screen printing machine 104 is removed. The screen printing machines 102, 104 are arranged in spaced apart end-to-end longitudinal alignment.

The specific spacing required between the screen printing machines 102, 104 depends upon whether the machines operate on a standard repeat of 24 inches between centers of the pallets 124 or on a jumbo repeat of 32 inches between the centers of the pallets. In the case of a standard repeat, this spaced distance is 72 inches which may be measured from the front or rear locator mechanisms 125 as previously described as a reference point. In the case of a jumbo repeat, this spaced distance is 96 inches. In either case, the space between the screen printing machines 102, 104, is sufficient to accommodate four additional pallet support plates 122, two on the printing side and two on the loading/unloading side as shown.

The frames 108 of the screen printing machines 102, 104 are mechanically and fixedly connected by means of a plurality of connecting braces 148 secured to cross braces 150 provided on opposing end portions of the frames 108. The opposing ends of the drive chain guides 110, 112 are interconnected by the addition of extension drive chain guides 152, 154 of similar construction secured extending through the spaced location between the screen printing machines 102, 104. The extension drive chain guides 152, 154 may be secured, for example, to adjacent portions of the frames 108 such as generally at locations 155. The existing drive chains 114 from each of the screen printing machines 102, 104 may be interconnected to form a continuous closed oval path by means of one or more auxiliary chain links 156 having spaced upstanding pins 120. In the alternative, an entirely new drive chain 114 may be installed within the guides 110, 112, 152, 154.

An auxiliary support rail 158 is arranged in longitudinal alignment with the ends of support rails 130 and secured to portions of the frame 108 of each of the screen printing machines 102, 104, such as at locations 159. The auxiliary support rail 158 provides support for the forward end of the pallet support plates 122 as they are indexed through the space occupied by the interconnecting assembly 106. In a similar manner, the free ends of the support rail 136 may be interconnected by an auxiliary tubular support rail 160. However, the auxiliary tubular support rail 160 does not contact the pallet support plates 122, rather being spaced therefrom to enable the loading and unloading of articles to be screen printed upon the pallets 124. In order to improve the operation of the serigraphic printing apparatus 100, the upper edges of the support rails 130, 132, 134 are provided with a layer of HYFAX synthetic material to eliminate unnecessary friction and drag with the pallet support plates 122.

In accommodating the drive chain 114, the drive gear assembly 116 and motor 115 within the first screen printing machine 102 are disconnected, while the idler gear 118 within the second screen printing machine 104 is disconnected. As shown in FIG. 1, the drive chain 114 is driven by a single hydraulic motor 115 at the rightmost end of the second screen printing machine 104 via the drive gear assembly 116. It is preferred, however, that the horse power of motor 115 be stepped up to accommodate the additional load. The gear ratio within the drive gear assembly 116 may be appropriately selected to reduce the torque on the drive shaft 164 and to advance the pallet support plates at the desired indexing speed. It is also contemplated that the drive chain 114 can be driven at both ends if so desired.

The serigraphic printing apparatus 100 of the present invention is constructed by operatively joining a pair of obsolete screen printing machines 102, 104 in a novel way to provide a single new machine providing increased printing and open station capabilities. In this regard, one or more of the printing stations 141 within each of the printhead assemblies 140 may be designated as open stations to accommodate such operations as flashing, cooling or the like. In addition, these operations may also be performed by installing suitable equipment overlying one or more of the pallet support plates 126 in the interconnecting assembly 106 between the pair of screen printing machines 102, 104. The serigraphic printing apparatus 100 accordingly has transformed two old and obsolete screen printing machines 102, 104 into an entirely new machine which has the capacity of meeting today's needs of the textile screen printing industry.

Figure 4:
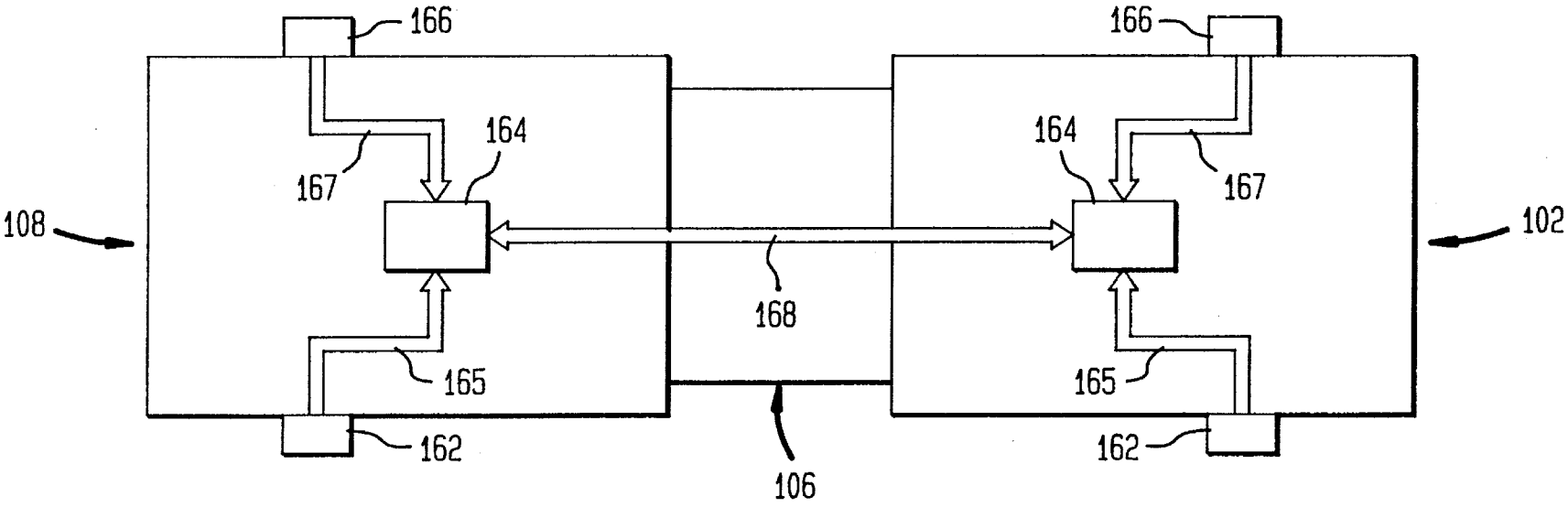
FIG. 4 is a diagrammatic illustration of the communication path established for the independent and concurrent synchronized operation of the serigraphic apparatus of the present invention.

Referring now to FIG. 4, there will be described the established controlled communication path between the screen printing machines 102, 104 during operation thereof. In this regard, it is to be noted that the operation of each screen printing machine 102, 104 remains the same as before the two machines were joined together. In other words, the screen printing machines 102, 104 are now operated in synchronized relationship, if desired, as opposed to being independently operated when previously separated.

To this end, each of the screen printing machines 102, 104 contains an original master control box 162 providing for the basic operating functions of cycling (continuous operation), indexing (intermittent manual operation) and load delay (duration between indexing). Operating signals from the master control box 162 are communicated to a respective auxiliary junction control box 164 by a communication bus 165. The master control boxes 162 are positioned on the printing side of the screen printing machines 102, 104, while the auxiliary junction boxes 164 are typically provided inside the frames 108. A cycle controller 166 is provided on the loading/unloading side of each of the screen printing machines 102, 104 and communicates with the auxiliary junction box 164 by a communication bus 167. Direct communication between the auxiliary junction boxes 164 is provided by a communication bus 168.

All communication signals received within one of the auxiliary junction boxes 164 are immediately communicated to the other auxiliary control box via the communication bus 168 to provide synchronized operation of the individual screen printing machines 102, 104. To this end, the auxiliary junction boxes 164 are provided with a plurality of conventional relays to communicate the appropriate operating signals back and forth between the screen printing machines 102, 104.

In operation, in order for the serigraphic printing apparatus to be in an automatic operative mode, the four cycle switches in each of the two master control boxes 162 and two cycle controllers 166 must be activated. If any one of these four cycle switches is disabled, the automatic operation of the serigraphic printing apparatus 100 is immediately terminated, and operation defaults to a manual mode. From any one of the master control boxes 162, the pallet support plates 122 may be continuously indexed automatically or on a manual basis. The indexing may be single pallet indexing by advancing the pallet support plates 122 one adjacent printing station 141. On the other hand, the indexing may be double pallet indexing to the second printing station 141. Double indexing enables the running of two separate production jobs for different color patterns to be screen printed within the same serigraphic printing apparatus 100.

During the screen printing operation, it is typical for the printhead assemblies 140 of the screen printing machines 102, 104 to operate in synchronized relationship. However, it is possible to operate only one of the printhead assemblies 140 within one of the screen printing machines 102, 104 when small jobs of limited color patterns are being produced. Thus, it can be appreciated, that the serigraphic printing apparatus 100 of the present invention has great utility in accommodating various screen printing requirements which would otherwise be impossible to meet when individually using the previously obsolete screen printing machines 102, 104.

The screen printing operation is carried out in a conventional way as was previously known with respect to the individual operation of the obsolete screen printing machines 102, 104. In particular, the pallet support plates 122 are indexed to a position underlying one of the printing stations 141 within the printhead assemblies 140. The individual patterned screens are flooded with the printing ink to prepare for the printing operation. The printhead assembly 140 is pivoted to its closed position by operation of the crank arms 142, 144. Subsequently, the locator assembly (not shown) is activated to precisely locate the pallet support plate 122 and accordingly register the article to be printed with the patterned screen. Immediately thereafter, the squeegee mechanism is operative to print the desired pattern on the underlying article. The printhead assembly 140 is subsequently pivoted to its open position and the locator assembly disenabled to free the pallet support plates 122, which are then indexed to the next printing station 141. The printed articles are removed from the serigraphic printing apparatus 100 along the loading/unloading side for subsequent processing, such as drying, folding and packaging.

Although the invention herein has been described with references to particular embodiments, it is to be understood that the embodiments are merely illustrative of the principles and application of the present invention. It is therefore to be understood that numerous modifications may be made to the embodiments and that other arrangements may be devised without departing from the spirit and scope of the present invention as defined by the claims.

What is claimed is:

1. A method of assembling a screen printing machine, said method comprising partially disassembling a pair of obsolete screen printing machines, each of said machines including a printhead, a plurality of pallet support plates, and a continuous closed path drive chain for advancing said pallet support plates through said printhead, connecting said pair of partially disassembled obsolete screen printing machines together in fixed spaced relationship, forming a single continuous closed path for advancing said pallet support plates through said pair of obsolete screen printing machines, and providing an additional plurality of pallet support plates.

2. The method of claim 1, further including providing a single continuous drive chain for advancing said plurality of pallet support through said pair of obsolete screen printing machines.

3. The method of claim 2, further producing drive chain guides for said drive chain within the space between said pair of obsolete screen printing machines.

4. The method of claim 1, further including providing an additional plurality of pallet support plates.

5. The method of claim 1, further including providing a support for said plurality of pallet support plates within the space between the pair of obsolete screen printing machines.

* * * * *